US007775781B2

(12) United States Patent
Maki et al.

(10) Patent No.: US 7,775,781 B2
(45) Date of Patent: Aug. 17, 2010

(54) DOUBLE ACTION SIMPLEX DIAPHRAGM PUMP

(75) Inventors: Bruce A. Maki, Hugo, MN (US); Daniel A. Beilke, Blaine, MN (US)

(73) Assignee: Hypro, LLC, New Brighton, MN (US)

( * ) Notice: Subject to any disclaimer, the term of this patent is extended or adjusted under 35 U.S.C. 154(b) by 219 days.

(21) Appl. No.: 12/215,030

(22) Filed: Jun. 24, 2008

(65) Prior Publication Data

US 2008/0267801 A1 Oct. 30, 2008

Related U.S. Application Data

(62) Division of application No. 10/789,591, filed on Feb. 27, 2004, now Pat. No. 7,390,175.

(51) Int. Cl.
*F04B 53/10* (2006.01)

(52) U.S. Cl. ..... 417/568; 417/534

(58) Field of Classification Search ..... 60/779, 60/39.091, 39.094; 220/749, 745–750; 417/568, 417/521, 534, 535, 536, 537, 360, 415
See application file for complete search history.

(56) References Cited

U.S. PATENT DOCUMENTS 4,079,275 A * 3/1978 Fu ..... 310/57
5,141,413 A * 8/1992 Bennitt ..... 417/523
5,173,039 A * 12/1992 Cook ..... 417/534
5,183,396 A * 2/1993 Cook et al. ..... 417/534
6,257,843 B1 * 7/2001 Cook et al. ..... 417/360

* cited by examiner

*Primary Examiner*—Michael Cuff
*Assistant Examiner*—Vikansha S Dwivedi
(74) *Attorney, Agent, or Firm*—Greenberg Traurig, LLP

(57) ABSTRACT

A double-acting, simplex, fluid handling pump is designed to facilitate an optional configuration as either a plunger pump or a diaphragm pump. An injection molded plastic pump body comprises two bilaterally symmetrical halves that include internal pockets and grooves for clamping and retaining first and second generally identical valve assemblies at opposing end portions of the pump body. When configured as a plunger pump, first and second plunger are arranged to move 180 degrees out-of-phase with respect to one another within stationary guide sleeves that are clamped within the pump body where one plunger effecting a suction stroke while the other effects a compression stroke. When configured as a diaphragm pump, the plungers are removed from the connecting rods and replaced by diaphragms and a change is made in the valve casing employed but a majority of the remaining parts of the pump assembly remain unchanged from what is used in the plunger pump.

8 Claims, 9 Drawing Sheets

DOUBLE ACTION SIMPLEX DIAPHRAGM PUMP

RELATED APPLICATIONS

This application is a divisional of U.S. application Ser. No. 10/789,591 filed Feb. 27, 2004, now U.S. Pat. No. 7,390,175 the entire contents of which are incorporated herein by reference.

BACKGROUND OF THE INVENTION

I. Field of the Invention

This invention relates generally to a double acting simplex fluid handling pump, and more particularly to such a pump having a housing that permits adaptation to either a plunger pump or a diaphragm pump using many of the same internal parts in each.

II. Discussion of the Prior Art

A variety of double acting fluid handling pumps are known in the art and are typically constructed so as to include a cast iron or aluminum housing, each of which requires rather extensive and costly machining. Such designs cannot be used to pump caustic chemicals because the housing and many of the internal parts of such prior art pumps become corroded, resulting in pump failure within a relatively short period of time.

Thus, a need exists for a relatively low cost, long-lasting, simplex, double-acting pump capable of pumping both chemically inert liquids and caustic liquids. The present invention meets this need.

SUMMARY OF THE INVENTION

The present invention comprises a fluid handling pump that is configurable either as a plunger pump or a diaphragm pump and that uses the same pump body and many of the internal working parts for each. The pump body itself is unique in that it comprises first and second bilaterally symmetrical halves that, when joined together about a midline, plane form an enclosed cavity. Each of the pump body halves includes a tubular pipe member with first and second ends. One of the first and second ends of the tubular pipe member on the first housing half comprises a low pressure fluid inlet port. In a like manner, one of the first and second ends of the tubular pipe member on the second pump body half comprises a high pressure fluid outlet port. The enclosed cavity defines first and second transversely extending pockets, each of which is in fluid communication with the lumens of the tubular pipe members and a longitudinally extending pocket that intersects with the first and second transversely extending pockets. Located in the longitudinally extending pocket are first and second reciprocally slidable connecting rod members that support either a plunger member, when the fluid handling pump is configured as a plunger pump, or a diaphragm when the fluid handling pump is configured as a diaphragm pump.

Fitted individually into the first and second transversely extending pockets are first and second identical valve assemblies. Each of the valve assemblies comprises a tubular body that supports an inlet poppet valve and an outlet poppet valve in spaced apart relation in opposed ends of the tubular body. The tubular body of each of the valve assemblies includes a central opening that is generally aligned with either the plunger or the diaphragm, depending upon whether the fluid handling pump is configured as a plunger pump or a diaphragm pump. An eccentric is operatively coupled to the reciprocally slidable connecting rod members for imparting reciprocating strokes to the plunger or diaphragm.

Although a die cast metal may be used, the pump body of the present invention is preferably an injection molded part formed from a suitable plastic, such as a polyester plastic material, preferably glass reinforced polybutylene terephthalate, and the only parts of the pump assembly that are not fabricated from an appropriate plastic are stainless steel springs forming part of the poppet valves. As such, the fluid-handling pump of the present invention is well suited for use in pumping a wide variety of corrosive chemicals.

DESCRIPTION OF THE DRAWINGS

Other features and advantages of the present invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
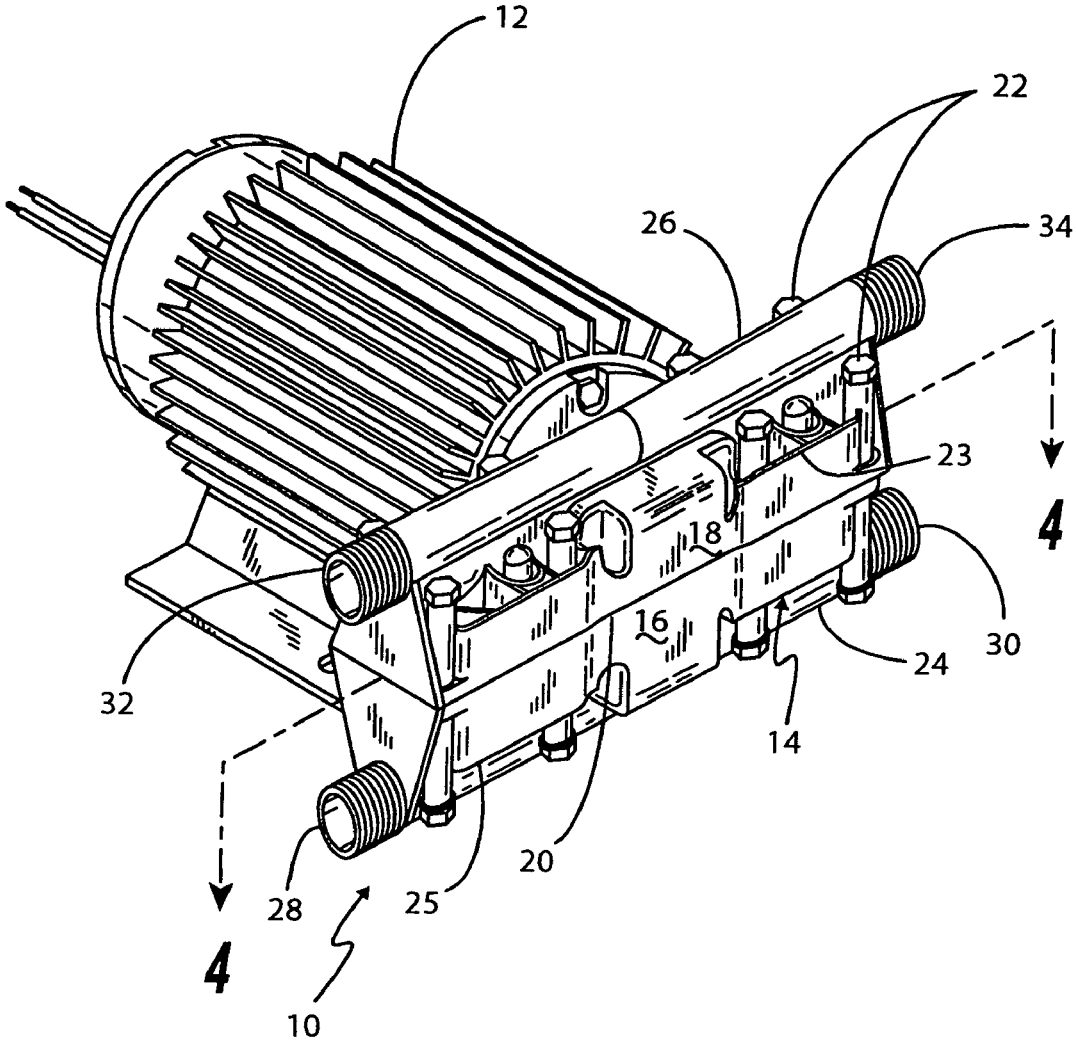
FIG. 1 is a perspective view of the preferred embodiment of the present invention.

Certain terminology will be used in the following description for convenience in reference only and will not be limiting. The words "upwardly", "downwardly", "rightwardly" and "leftwardly" will refer to directions in the drawings to which reference is made. The words "inwardly" and "outwardly" will refer to directions toward and away from, respectively, the geometric center of the device and associated parts thereof. Said terminology will include the words above specifically mentioned, derivatives thereof and words of similar import.

Referring first to FIG. 1, there is illustrated a perspective view of the preferred embodiment of the double acting, simplex, fluid handling pump comprising a preferred embodiment of the present invention. The pump is indicated generally by numeral 10 and is shown as being attached to an electric drive motor 12 in a manner that will be described in greater detail herein below. The pump 10 includes a pump body 14 that comprises a lower body half 16 and an upper body half 18, the two being bilaterally symmetrical and, therefore, being identical parts. Each is preferably injected molded from a suitable plastic, taking into account operating pressures, speeds and the nature of the fluid being pumped. A polyester plastic, and preferably glass reinforced polybutylene terephthalate has been found suitable for many applications. It is to be understood, however, that a die cast metal pump body can be used as well. The two body halves 16 and 18 are joined together about a midline plane 20 by nut and bolt fasteners as at 22 that pass through aligned apertures formed through the thickness dimension of laterally extending flange portions 23 and 25 of the upper and lower pump body halves, 18 and 16, respectively.

As seen in FIG. 1, the lower 16 and upper 18 body halves each include a tubular pipe member, with pipe member 24 forming a part of the lower body member 16 and tubular pipe 26 forming part of the upper pump body member 18. Pipe member 24 has first and second ends 28 and 30. Likewise, tubular pipe member 26 has first and second ends 32 and 34. In use, either end 28 or 30 of the pipe member 24 may serve as a lower pressure fluid inlet port while the opposite end thereof is suitably capped by a threaded end cap (not shown). Likewise, either end of the pipe member 26 may serve as a high pressure fluid outlet port, again with the opposite end suitably capped with a screw-on cover (not shown). By having both ends of each of the tubular pipes 24 and 26 threaded, flexibility is afforded for the external connection of a fluid supply hose and a high pressure output hose.

Further, and as will be explained in greater detail below, depending upon the orientation of valve assemblies within the pump body 14 either pipe member 24 or tubular pipe member 26 may serve as the low pressure manifold with the other functioning as the high pressure manifold.

Figure 2:
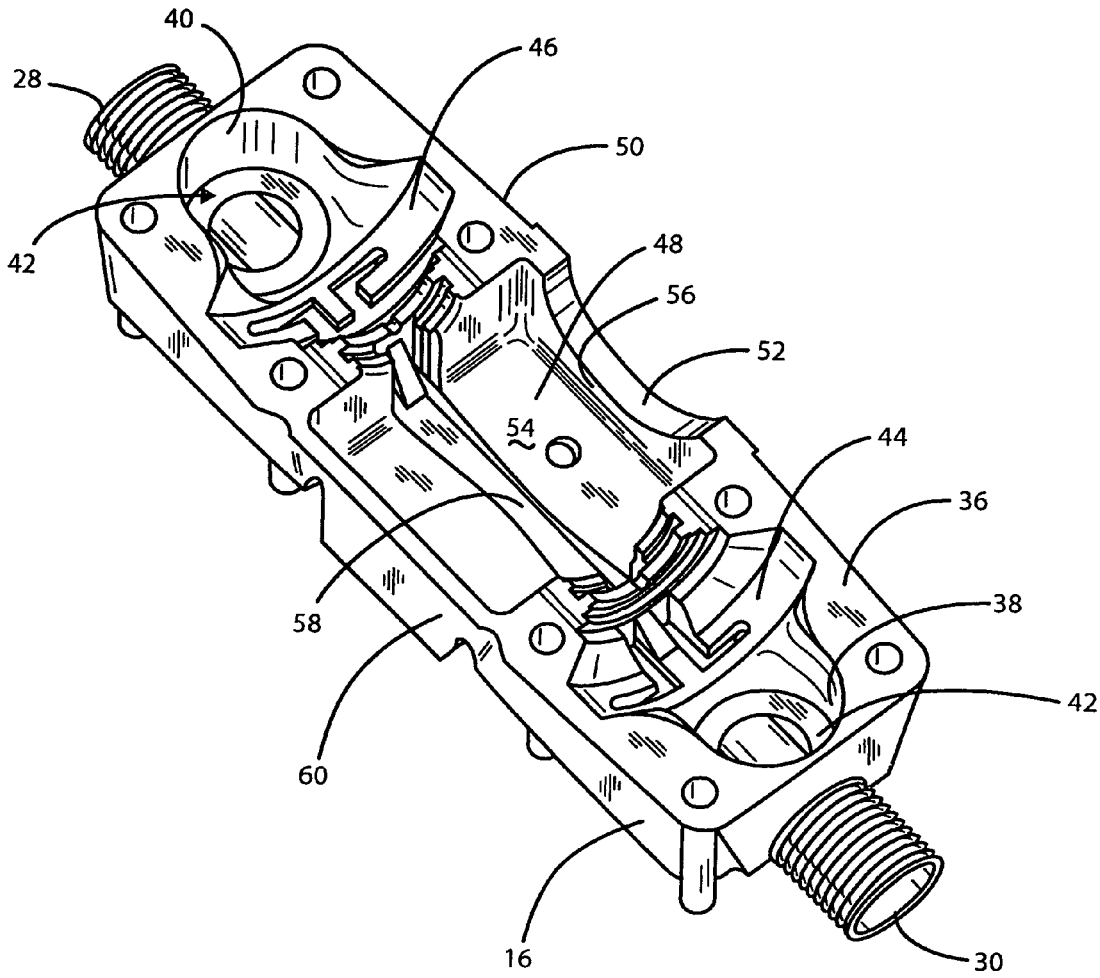
FIG. 2 is a perspective view of an injection molded, plastic pump body half.
Figure 3:
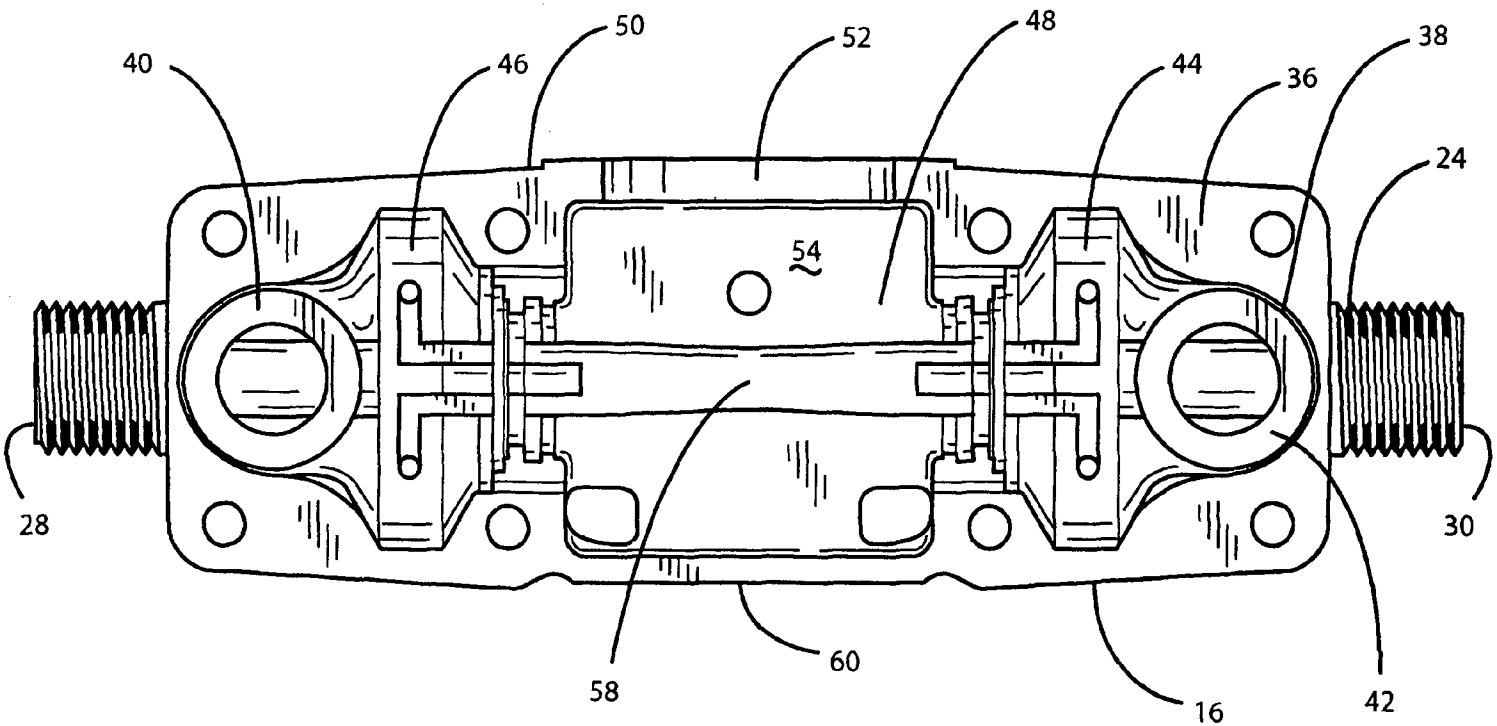
FIG. 3 is a top plan view of the lower housing half shown in FIG. 1 or a bottom view of the top pump body half shown in FIG. 1, the two being identical.

Turning next to FIGS. 2 and 3, the internal constructional features of the upper and lower pump body halves 16 and 18 can be viewed. Each of the upper and lower pump body halves has a planar surface 36 and formed inwardly thereof proximate opposed ends are first and second transversely extending pockets 38 and 40 leading to a flat annular surface 42 at the base of the pocket. The open center of the surface 42 leads to a bore (not shown) formed through the wall of the pipe members 24 and 26.

Located longitudinally inward of the pockets 38 and 40 are semicircular recesses 44 and 46 and centrally disposed between the two ends is a generally rectangular pocket 48. The rear wall 50 of the pump body halves 16 and 18 each includes a semicircular opening 52 therein leading to the pocket 48. The bottom surface 54 of the pocket 48 includes an arcuate groove 56 adjacent to the rear wall 50 and a longitudinal groove 58 of semicircular cross section approximately midway between the rear wall 50 and a front wall 60.

Plunger Pump Configuration

Figure 4:
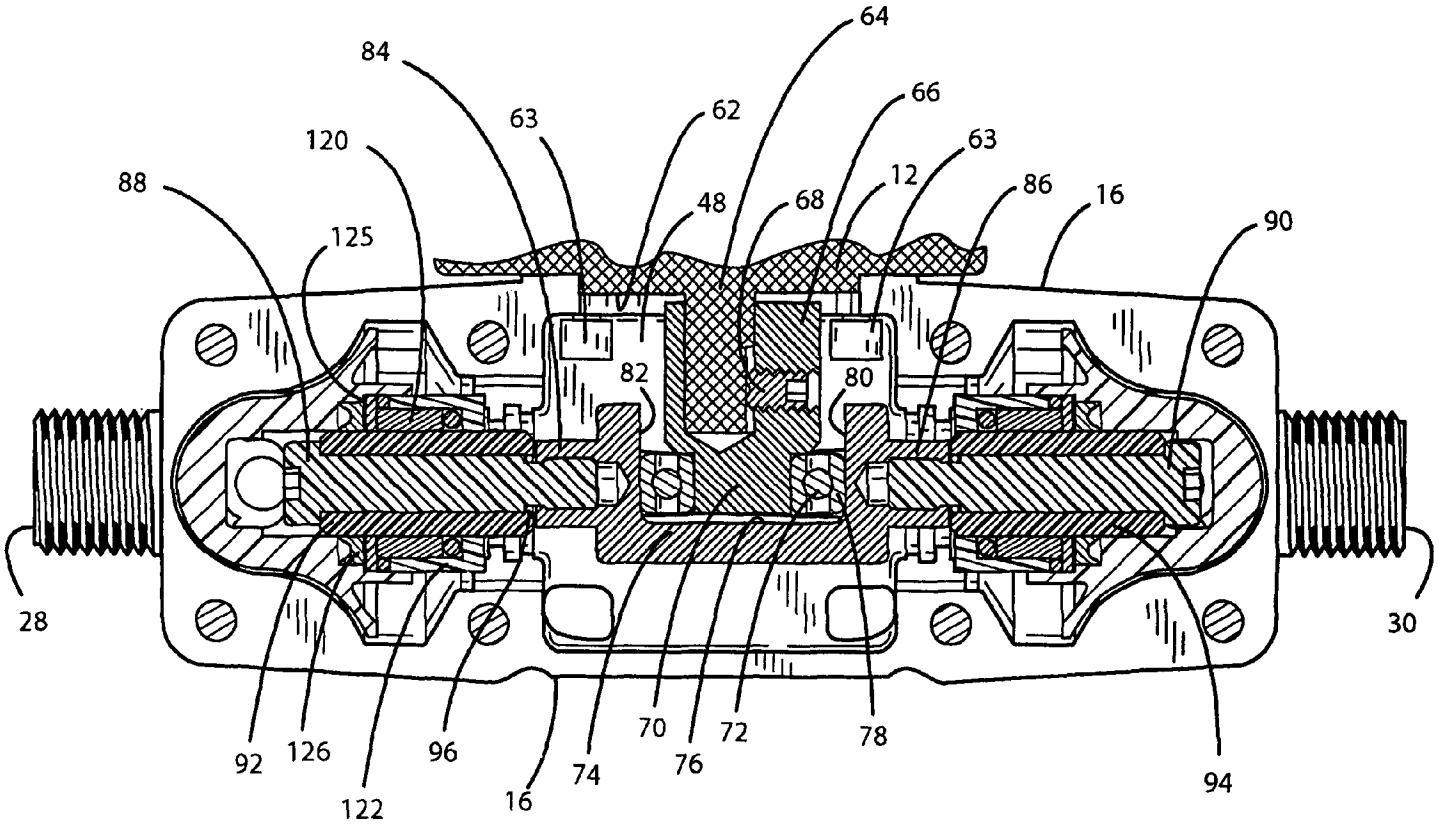
FIG. 4 is a horizontal, longitudinal cross-sectional view taken in direction of the arrows 4-4 in FIG. 1 when the pump is configured as a plunger pump.

Attention is next directed to the cross sectional view of FIG. 4 which shows the lower pump body half 16 when containing the internal parts for implementing a plunger pump. As can be seen, the semi circular opening 52 in the rear sidewall is designed to accept a cylindrical projection 62 formed on the front end of the drive motor 12 therethrough. The pump is joined to the motor by bolts, as at 63. The motor shaft 64 extends into the rectangular pocket 48 and mounted thereon is an eccentric member 66 that is held in place on the shaft by a setscrew 68. The eccentric 66 includes a centrally disposed cylindrical nose portion 70 that extends through the central opening of a ball bearing set 72.

A generally cylindrical shuttle member 74 has a notch 76 formed therein into which the bearing set 72 is made to fit with outer race 78 abutting the shoulders 80 and 82 defining the opposed ends of the notch 72.

The shuttle member 74 includes cylindrical stubs 84 and 86 on opposed ends thereof and the stubs, in turn, include longitudinally extending threaded bores into which are screwed connecting rod members 88 and 90. The connecting rod members may comprise shoulder bolts that pass through cylindrical, tubular plungers 92 and 94 that are preferably formed from a suitable ceramic and which are polished to provide a smooth, uniform outside cylindrical surface. The inner ends of the plunger members 92 and 94 are held in tight abutting relationship to the ends of the stubs 84 and 86 of the shuttle member 74 and O-rings, as at 96, serve as a seal to prevent fluid leaking along the interface between the connecting rods 88 and 90 and their respective plungers 92 and 94 from reaching the desired dry portions of the pump assembly including the rectangular pocket 49 and the component parts located there.

Figure 6:
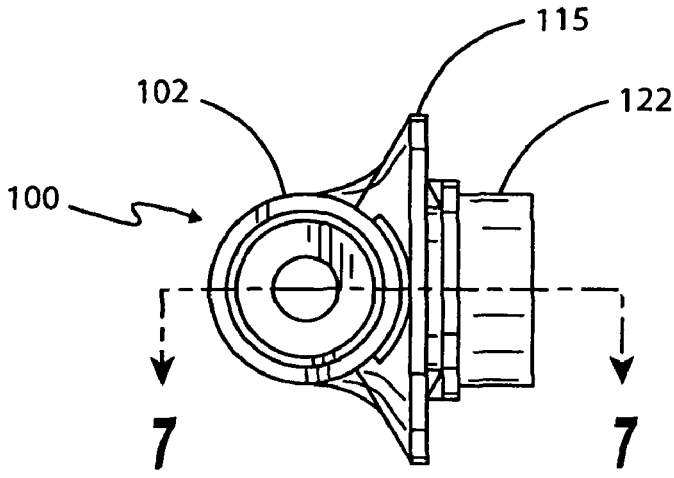
FIG. 6 is a top plan view of the valve assembly used in the pump of FIG. 4 when configured as a plunger pump.
Figure 7:
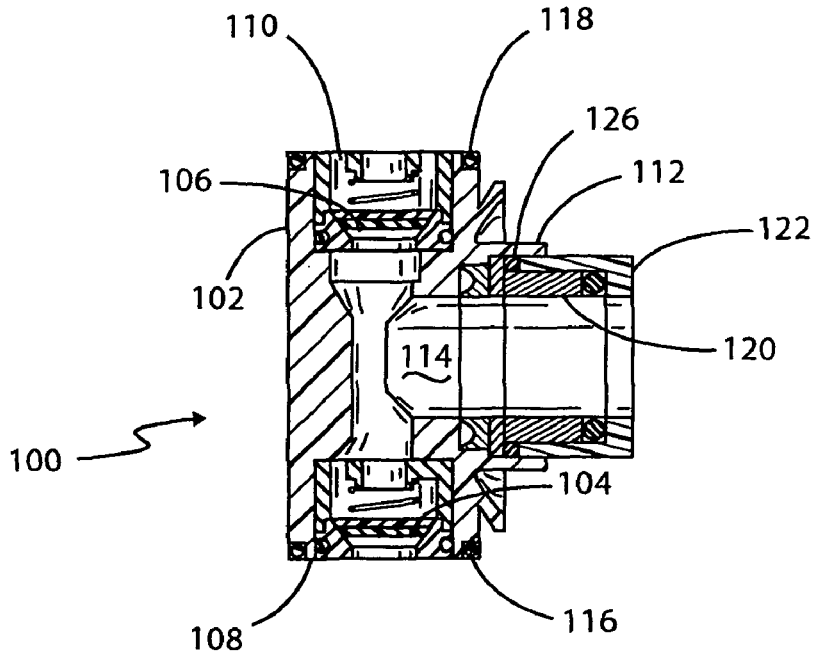
FIG. 7 is a cross-sectional view taken along the line 7-7 in FIG. 6.

Next, turning momentarily to FIGS. 6 and 7, there is shown a valve assembly to be used when configuring the fluid handling pump as a plunger pump. The valve assembly is indicated generally by numeral 100 and includes a tubular valve casing 102 supporting an inlet poppet valve 104 and an outlet poppet valve 106 in spaced apart relation in the opposed end portions 108 and 110 of the tubular casing 102. The poppet valve assembly used in the device is entirely conventional and employ a spring to normally urge the disk-like poppet valves in sealed relation relative to a cooperating valve seat formed in the valve cage. The tubular casing 102 of the valve assembly 100 includes a central opening 112 leading to an internal chamber 114. A somewhat frustoconically-shaped flange 115 is integrally molded with the tubular body 102 and it is adapted to fit into either of the recesses 44 or 46 of the pump body 16 such that the tubular valve casing occupies one of the pockets 38 and 40. O-ring seals, as at 116 and 118, cooperate with the annular surfaces 42 formed in the pockets 38 and 40 to provide sealing therebetween.

Figure 9:
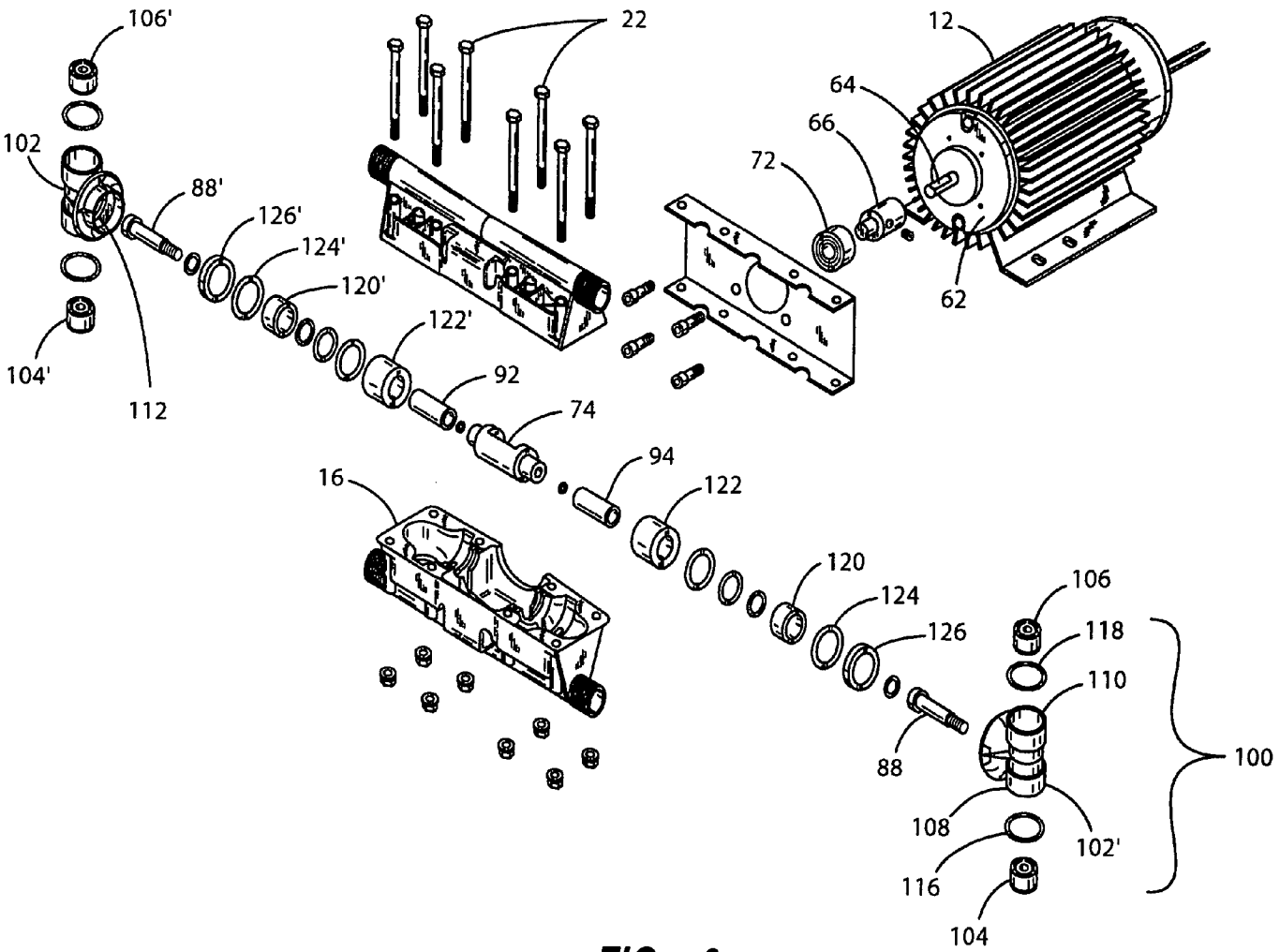
FIG. 9 is an exploded view of the entire fluid handling pump assembly when configured as a plunger pump.

As seen in FIGS. 4 and 7, a smooth carbon guide sleeve 120 is captured within a cylindrical tubular retainer 122 which fits into the central opening 112 of the valve casing and the inner end of the retainer 122 abuts a washer 124 that is used to hold an elastomeric cup seal 126. As seen in FIG. 4, the plunger 92 passes through the carbon guide sleeve 120 and cooperates with the cup seal 126 to preclude fluid flow along the OD of the plunger 92. The plunger 94 has an identical guide and seal arrangement. The exploded view of FIG. 9 will aid the reader in understanding the overall construction manner in which the plunger pump is assembled.

Operation—Double Acting Plunger Pump

Referring primarily to FIGS. 1, 4 and 7, the operation of the fluid handling pump when configured as a plunger pump will next be described.

As the electric motor 12 drives the eccentric 66, the ball bearing set 72 carried by the nose 70 of the eccentric will impart reciprocating linear motion to the shuttle member 74 by virtue of the engagement of the bearing's outer race 78 with the shoulders 80 and 82 of the shuttle member. This, in turn, will impart rectilinear reciprocating movement of the plungers 92 and 94. Assuming that the pipe 24 is the low pressure inlet manifold of the pump, that pipe 26 is the high pressure outlet manifold and that one end of each of the pipes is capped, during a suction stroke of the plunger, i.e., when the plunger is moving toward the central axis of the pump, the fluid to be pumped will be drawn through the poppet valve 104 into the chamber 114. Now, when the plunger begins its compression stroke, i.e., moves toward the valve assembly, the poppet valve 104 will seat while the poppet valve 106 is forced open against its spring, allowing the fluid in the chamber 114 to be forced out, under pressure, through the uncapped outlet port 32 or 34 of the pipe 26. Because of the push/pull action of the pistons 92 and 94, one complete revolution of the eccentric 66 will result in two suction strokes and two pressure strokes such that the high pressure fluid leaving the high pressure outlet will be somewhat less pulsatile than if only a single plunger is involved.

Diaphragm Pump Configuration

Figure 5:
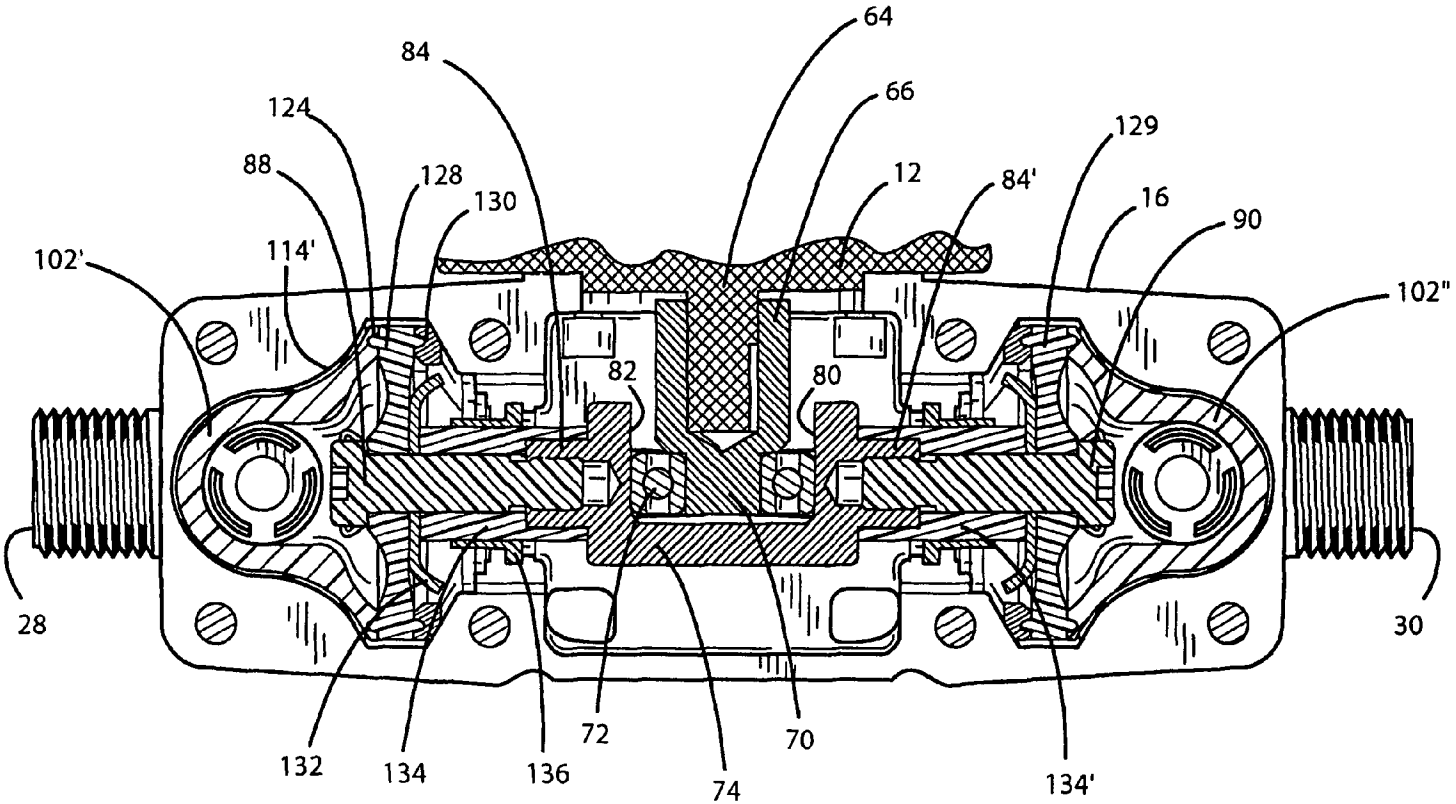
FIG. 5 is a view similar to that of FIG. 4 when the pump in configured as a diaphragm pump.
Figure 10:
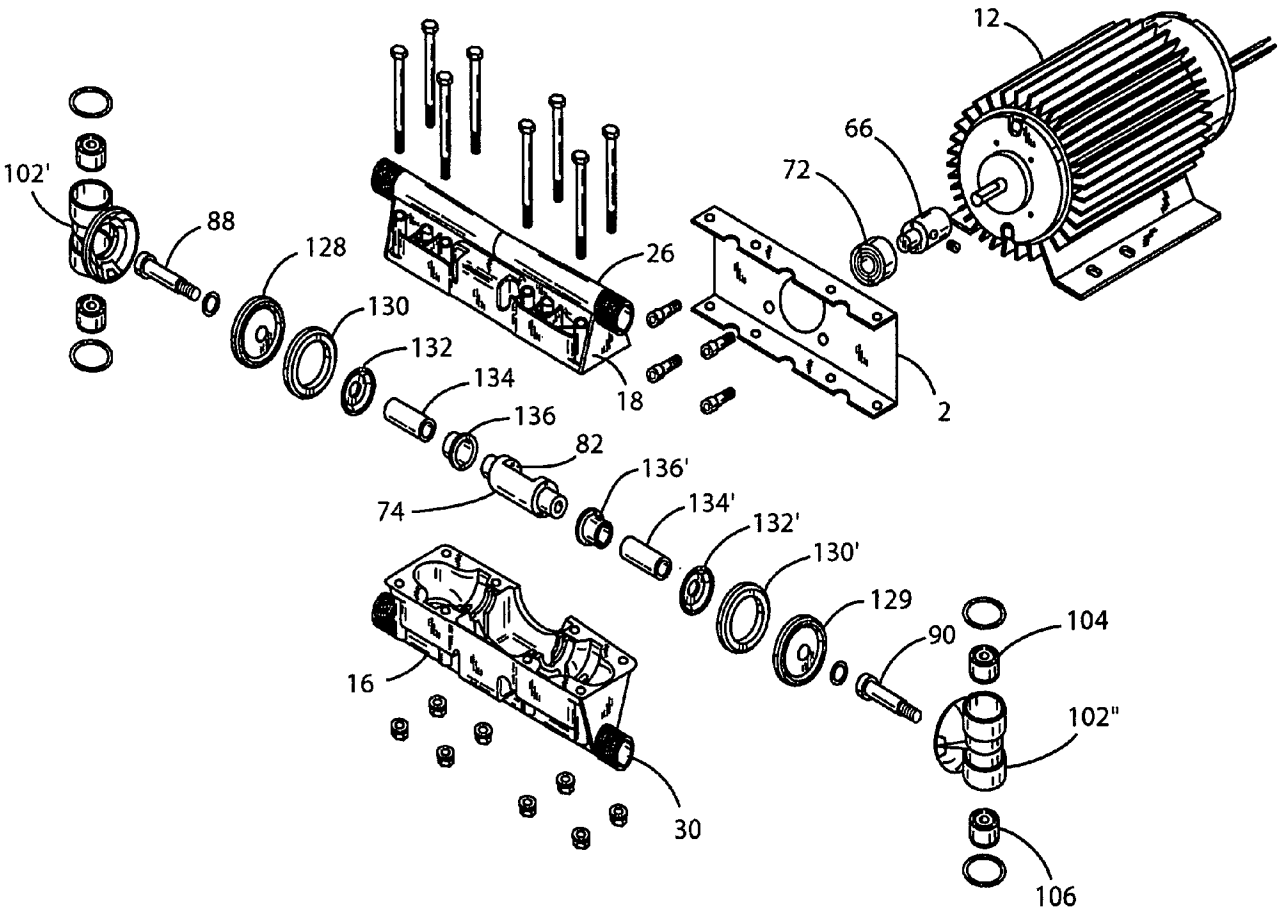
FIG. 10 is an exploded view of the entire pump assembly when configured as a diaphragm pump.

Referring next to FIGS. 5 and 10, there are shown a cross-sectional view through the fluid handling pump and an exploded view thereof when configured as a diaphragm pump. It will be recognized that many of the parts used in implementing the diaphragm pump are the same as those used in implementing the plunger pump. For example, the pump body halves 16 and 18 are identical to one another and are the same as are used in the plunger pump of FIG. 4. The motor 12 may be the same as are the eccentric 66, the bearing 72, the shuttle 74, the connecting rods 88 and 90. Also, the poppet valves employed may be identical, although the tubular bodies 102' and 102" (FIG. 8) are slightly different in that the frustoconical portion 114' is provided with a groove 124 for receiving an annular rib 126 that projects from one side surface of an elastomeric diaphragm 128/129 proximate its periphery. A clamping ring, as at 130, is designed to fit within the arcuate recess 46 formed in the pump body (halves) 16, 18 and it engages an annular rib 132 formed on the side of the diaphragm member 128 that is opposite from the rib 126. It can be seen, then, that the diaphragm 128 is captured only proximate a peripheral edge portion thereof and the remaining portion of the diaphragm are free to flex or distort as the connecting rods reciprocate.

Shoulder bolts comprising the connecting rods 88 and 90 each pass through a central aperture formed in the respective diaphragms. When the threaded end is tightened into one of the stub portions 84 or 84' of the shuttle 74, it is held against an arcuate backing plate 133 that is captured between the diaphragm 128 or 129 and a tubular bushing 134 or 134' designed to mate with the stub 84 or 84' of the shuttle 74. The bushings 134 and 134' are preferably made of a carbon or bronze material to provide a low friction engagement with a surrounding stationary bushing 136 or 136' that is captured in a groove formed in the pump body.

The poppet valves that fit into the opposed ends of the tubular valve housing 102' are substantially identical to the poppet valves 104 and 106 used in the plunger pump. Each includes an open cage structure 138 containing a spring 140, preferably fabricated from stainless steel so as to resist corrosion and which cooperates with a poppet to normally urge that poppet against an annular seat formed in the cage structure. O-ring seals, as at 142, prevent leakage between the tubular valve housing 102' and the cage structure 138. See FIG. 8.

Operation—Double-Acting Diaphragm Pump

Figure 8:
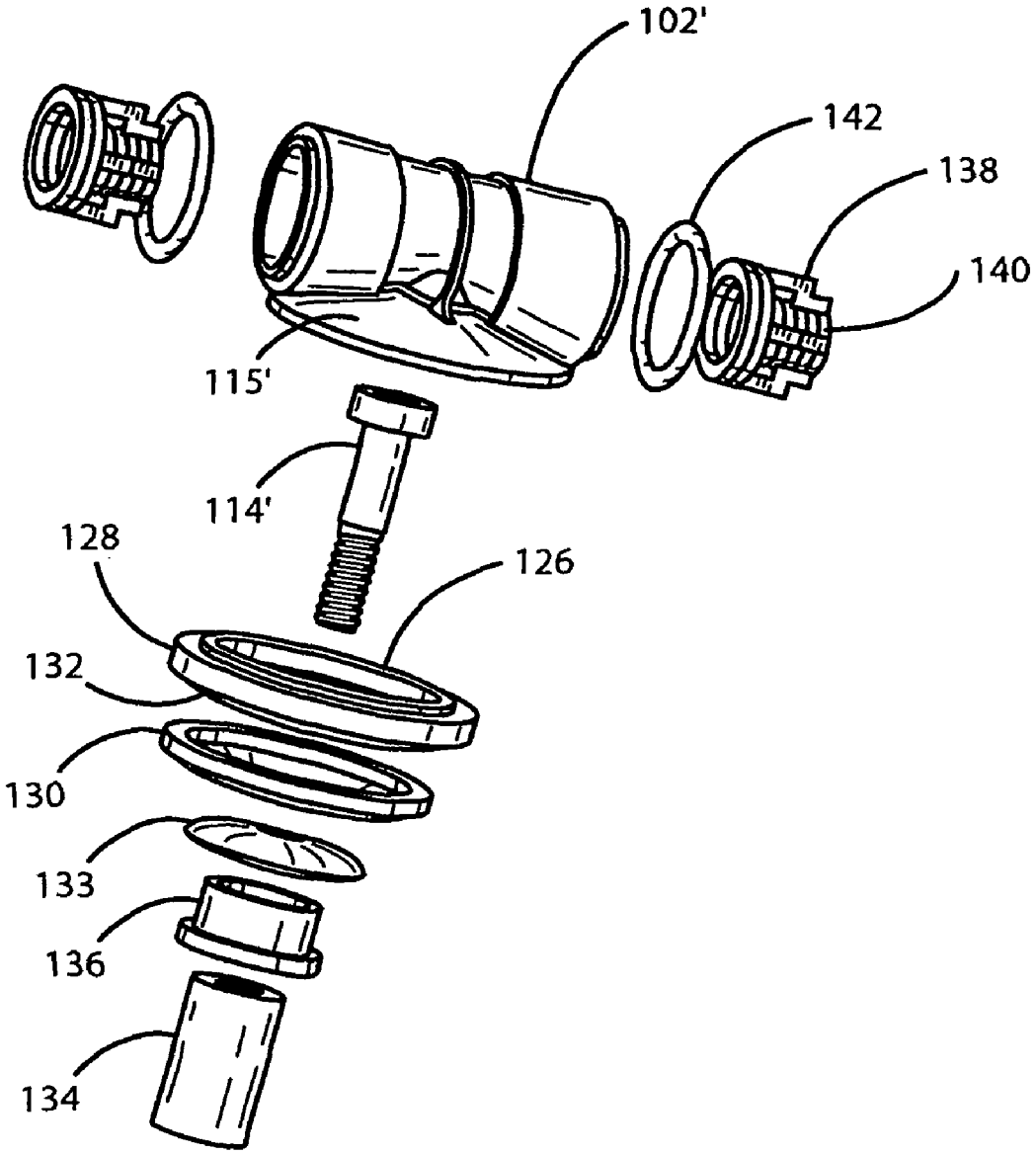
FIG. 8 is an exploded view of the valve assembly when the fluid handling pump is configured as a diaphragm pump.

With reference primarily to FIGS. 1, 5 and 8, the operation of the fluid handling pump when configured as a double-acting diaphragm pump will next be described.

As the electric motor 12 drives the eccentric 66, the ball bearing set 72 carried by the nose 70 of the eccentric will impart reciprocating linear motion to the shuttle member 74 by virtue of the engagement of the bearing's outer race with the shoulders 80 and 82 of the shuttle member. This, in turn, will impart rectilinear reciprocating movement of the connecting rods 88 and 90 within their guide sleeves 134.

Assuming again that the pipe 24 is the low pressure inlet side of the pump, that pipe 26 is the high pressure outlet side and that one end of each of the pipes is appropriately capped, as one of the connecting rods 88 or 90 moves toward the pump's center, a negative pressure is developed within its associated valve body 102' causing the inlet poppet valve to open, allowing the fluid to be pumped to fill the chamber 114 of the valve body 102' or 102". Now, as the motor shaft continues to rotate and the eccentric drives the diaphragm 128 or 128 into the frustoconical portion 115 of its associated valve casing, the liquid being pumped to flow through its discharge poppet valve into the discharge pipe 26 is forced at a high pressure. It will be appreciated that as the connecting rod 88 is moving to the left in FIG. 5 to create a pressure stroke, the connecting rod 90 is moving its diaphragm 129 in a direction to create a suction stroke. Thus, as the liquid being pumped is filling the valve chamber 102' of one of the valve assemblies, the liquid being pumped is being forced out of the high pressure discharge poppet of the other valve 102".

It can now be appreciated that the present invention provides an improved, double-acting, simplex plunger or diaphragm pump that is characterized by having a unique method of assembly involving all but a few of common parts and a structural pump body having internal recesses for retaining the necessary bushings and seals when the identically configured pump body halves are bolted together. The two pump body halves effectively "sandwich" and clamp into molded recesses two valve casings that are generally in the shape of a "T" fitting. The two opposing ends of the "T" fitting contain the inlet and outlet valves. These two valves are identical with only the orientation of the valve relative to the "T" housing changing, thus allowing the movement of the fluid through the chamber in only one direction. Each pump body half has two ports and a common connecting pipe or channel for connecting the two pumping chambers. Depending upon the valve orientation, the common connecting pipe becomes either a suction manifold or a discharge manifold. In that each identical pump body half has one such pipe or channel, there is then a suction and a discharge passage. The pump of the present invention can be readily converted from a piston pump to a diaphragm pump by merely replacing the tubular valve housings, and substituting a diaphragm for a plunger or vice versa while the remaining parts are common to both.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself

What is claimed is:

1. A fluid handling pump adapted to be configured as a diaphragm pump, the fluid handling pump comprising:

(a) a pump body comprising first and second bilaterally symmetrical halves joined together to form an enclosed cavity, each half including a tubular pipe member having first and second ends, one of said first and second ends on the tubular pipe member of the first half being a low pressure fluid inlet port and one of said first and second ends on the tubular pipe member of the second half being a high pressure fluid outlet port, said enclosed cavity defining first and second transversely extending pockets, each in fluid communication with lumens of the tubular pipe members and a longitudinally extending pocket intersecting with the first and second transversely extending pockets;

(b) first and second reciprocally slidable connecting rod members disposed in the longitudinally extending pocket and having one of a plunger and a diaphragm at an outer end thereof, (c) first and second valve assemblies fitted individually into the first and second transversely extending pockets, each of the first and second valve assemblies comprising a tubular valve casing supporting an inlet poppet valve and an outlet poppet valve in spaced apart relation in opposed ends of the tubular casing, the tubular casing of each of the first and second valve assemblies each including a central opening generally aligned with the diaphragm employed; and d) an eccentric operatively coupled to the first and second reciprocally slidable connecting rod members.

2. The fluid handling pump of claim 1 wherein the pump body is an injection molded polyester plastic material.

3. The fluid handling pump of claim 1 wherein the pump body is a die cast metal.

4. The fluid handling pump of claim 2 wherein the plastic material comprises glass reinforced polybutylene terephthalate.

5. The fluid handling pump as in claim 1 and further including a motor having an output shaft coupled to said eccentric and a motor housing attached to the pump body.

6. The fluid handling pump as in claim 5 wherein the eccentric includes a ball-bearing set having an outer race and the first and second reciprocally slidable connecting rod members are connected together by an intermediately located shuttle member having a slot formed therein for receiving the outer race of the ball-bearing set therein.

7. The fluid handling pump as in claim 1 and further including carbon guide sleeves disposed in surrounding relation to the first and second reciprocally slidable connecting rod members where the carbon guide sleeves are captured in the longitudinally extending pocket and limit the movement of the connecting rod members to a rectilinear path.

8. The fluid handling pump as in claim 1 wherein the inlet poppet valves are disposed between apertures formed through a sidewall of the pipe member having the fluid inlet port and said central opening and the outlet poppet valves are disposed between apertures formed through a sidewall of the pipe member having the high pressure fluid outlet port and said central opening.

* * * * *